US006817356B2

(12) United States Patent
Gallagher

(10) Patent No.: US 6,817,356 B2
(45) Date of Patent: Nov. 16, 2004

(54) METHOD AND APPARATUS FOR REMOVAL OF GREASE, SMOKE AND ODOR FROM EXHAUST SYSTEMS

(76) Inventor: Arlen W. Gallagher, 6575 Fenton St., Arvada, CO (US) 80003

( * ) Notice: Subject to any disclaimer, the term of this patent is extended or adjusted under 35 U.S.C. 154(b) by 0 days.

(21) Appl. No.: 10/418,603

(22) Filed: Apr. 18, 2003

(65) Prior Publication Data

US 2004/0206347 A1 Oct. 21, 2004

(51) Int. Cl.[7] ..... F24C 15/20

(52) U.S. Cl. ..... 126/299 E; 126/299 D

(58) Field of Search ..... 126/299 R, 299 D, 126/299 E, 301–303, 21 R; 55/DIG. 36; 454/56, 61, 67, 49, 58, 63, 57; 422/120, 121; 96/224

(56) References Cited

U.S. PATENT DOCUMENTS

| | | | | |
|---|---|---|---|---|
| 3,744,217 A | | 7/1973 | Ebert | |
| 3,837,269 A | | 9/1974 | Sweet, et al. | |
| 4,489,647 A | | 12/1984 | Stamps et al. | |
| 4,553,987 A | | 11/1985 | Artama et al. | |
| 4,603,031 A | | 7/1986 | Gelbman | |
| 4,976,752 A | | 12/1990 | Torok et al. | |
| 5,042,457 A | | 8/1991 | Gallagher | |
| 5,154,161 A | | 10/1992 | Rogers et al. | |
| 5,211,159 A | | 5/1993 | Lieblein et al. | |
| 5,316,741 A | | 5/1994 | Sewell et al. | |
| 5,681,533 A | * | 10/1997 | Hiromi | 422/121 |
| 5,824,274 A | | 10/1998 | Long | |
| 6,042,637 A | | 3/2000 | Weinberg | |
| 6,093,289 A | | 7/2000 | Kuzumoto et al. | |
| 6,235,090 B1 | | 5/2001 | Bernstein et al. | |
| 6,391,259 B1 | | 5/2002 | Malkin et al. | |
| 2002/0157661 A1 | | 10/2002 | Kornberger | |

FOREIGN PATENT DOCUMENTS

| | | | | |
|---|---|---|---|---|
| JP | 358008933 A | | 1/1983 | |
| JP | 36001642 A | | 1/1985 | |
| JP | 01184335 A | | 7/1989 | |
| JP | 3-109921 | * | 5/1991 | 126/299 R |
| JP | 9-253434 | * | 9/1997 | 126/299 E |
| JP | 02000093236 A | | 4/2000 | |
| JP | 2003-275528 | * | 9/2003 | 126/299 E |

* cited by examiner

*Primary Examiner*—James C. Yeung
(74) *Attorney, Agent, or Firm*—John E. Reilly; Ellen Reilly

(57) ABSTRACT

A grease, smoke, and odor extraction system includes an outer housing including a lower entrance passage and an upper exit duct for drawing the exhaust airstream upwardly through a scrubbing chamber, the lower entrance passage is fitted with a pipe which discharges ozone gas into the exhaust air and, alternatively, a water supply manifold which directs the water into the ozonated exhaust stream at the chamber area in such as way as to create a vortex of water droplets in the ozonated exhaust stream to encourage the extraction of grease, fumes, and other contaminants from the stream. Several alternate embodiments as described including a housing, an ozone generator, an ozone injector into the housing in combination with a baffle member and alternatively water and filter members for use with kitchen exhaust systems as well as water treatment systems and the like.

24 Claims, 6 Drawing Sheets

METHOD AND APPARATUS FOR REMOVAL OF GREASE, SMOKE AND ODOR FROM EXHAUST SYSTEMS

BACKGROUND AND FIELD OF INVENTION

This invention is directed to improvements in ventilating systems of the type disclosed in U.S. Pat. No. 5,042,457 ('457) for GREASE EXTRACTION VENTILATOR APPARATUS, by Arlen W. Gallagher, owned by the inventor of this invention. One purpose of the '457 patent was to provide a ventilator system in which the grease vapors and lint could be removed without a water reservoir or grease entrapment area at the bottom, as well as to avoid accumulation on the interior walls of the ventilator and particularly to avoid baked-on grease deposits which will prevent water from absorbing heat from the walls of the ventilator. Although the system of the '457 patent has proven highly effective in use, it does require some maintenance and cleaning on a regular basis as contaminants collect and accumulate on the interior walls of the ventilator.

It is desirable to provide a ventilator system in which contaminants, including odors, can be removed through use of ozone in combination with the creation of a vortex of exhaust air for extraction of contaminants from air and, alternatively, water or a method or means to avoid repeated cleaning of the apparatus.

SUMMARY OF THE INVENTION

It is therefore an object of the present invention to provide for a novel and improved contaminant extraction ventilator adaptable for use with cooking equipment and the like.

Another object of the present invention is to provide for a novel and improved method and means for extracting contaminants such as grease, odors and smoke as they are produced, rather than permitting them to become deposited on the interior walls of the ventilator or duct work.

Another object of the present invention is to provide a ventilator apparatus which generates a sheet or film of water with entrained ozone which is suspended and recirculated by a flow of air, thereby efficiently and continuously removing contaminants by centrifugal force, entrapment, oxidation and condensation.

Another object of this invention is to provide a ventilator apparatus which discharges ozone into an exhaust stream thereby oxidizing contaminants and avoiding repeated cleaning of the apparatus.

In accordance with the present invention, there is provided an apparatus for extracting grease and other contaminants from an exhaust airstream in which a housing includes means for inducing the flow of exhaust airstream therethrough and, alternatively, water-injecting means are provided for injecting water into the housing in countercurrent relation to the flow of the exhaust airstream, the improvement comprising a source of ozone and discharge means for injecting the ozone continuously into the exhaust airstream prior to intermixture of the exhaust airstream with the water so as to create a vortex of ozonated water for efficient removal of the grease and other contaminants from the airstream.

In accomplishing the foregoing, an ozone-producing apparatus, or ozone generator, produces a concentration of pure ozone which is introduced into the exhaust air which is moving upwardly through an air inlet passage between an air inlet baffle and a back wall of a scrubbing chamber. Fresh water is introduced above the air inlet and by gravitation moved downwardly along the air inlet baffle where it slides off horizontally into the vertically upward path of the ozonated exhaust airstream. The ozonated exhaust air is intercepted by the flow of water moving horizontally away from the air inlet baffle, thereby lifting the water upwardly and through a narrow channel formed by the air inlet baffle and the back wall of the scrubbing chamber. The ozonated exhaust air combines with the water flow causing ozone to be entrained within the water flow. Ozone is naturally unstable and will oxidize and react with a target compound, such as, grease, odors and smoke, the ozone reverting to molecular oxygen as a byproduct. As the volume of water suspended in the ozonated exhaust airstream increases, the weight of the water against the upward air movement will cause its spread in a horizontal direction resulting in an even distribution of recirculated water throughout the entire length of the unit. When the weight of water suspended within the ozonated airstream reaches the maximum amount that can be supported, it is free to drain downwardly along the rear wall of the scrubbing chamber into a full width trough; and the excess water together with any entrained contaminants may then be suitably carried away through a conventional drain into the building drainage system.

In an alternate embodiment of the present invention, there is provided a ventilating system for extracting grease, odors and solid particles from an exhaust airstream in which a housing includes an entrance passage and exit duct, means for inducing the flow of the exhaust airstream through the entrance passage, baffle means, ozone producing means, means for injecting ozone into the exhaust airstream from a location above the baffle means, the baffle means having a pair of spaced baffle supports and a baffle filter therebetween, and the baffle member extending diagonally along a substantial length of the housing.

A further embodiment includes a ventilating system for extracting grease, odors and solid particles from an exhaust airstream including a housing with an entrance passage, baffle means in the housing and a dry chamber, means for inducing the flow of the exhaust airstream therethrough, means for injecting the ozone into the exhaust airstream at the entrance passage, baffle means having spaced diverter panels, and means for injecting water into the housing from a location above the baffle means for discharging water into the housing in countercurrent relation to the flow of the exhaust airstream.

A final embodiment includes a ventilating system for extracting grease, fumes and solid particles from an exhaust airstream created by a cooking appliance including a housing with an entrance and exit passage, diffuse means and filter means contained within said housing, means for inducing the flow of the exhaust air through the housing, means for generating ozone and means for injecting ozone into the housing to provide even distribution of ozone gas into the exhaust airstream.

The above and other objects of the present invention will become more readily appreciated and understood from a consideration of the following detailed description of a preferred embodiment and several alternate embodiments when taken together with the accompanying drawings wherein:

DETAILED DESCRIPTION OF PREFERRED EMBODIMENT

Figure 1:
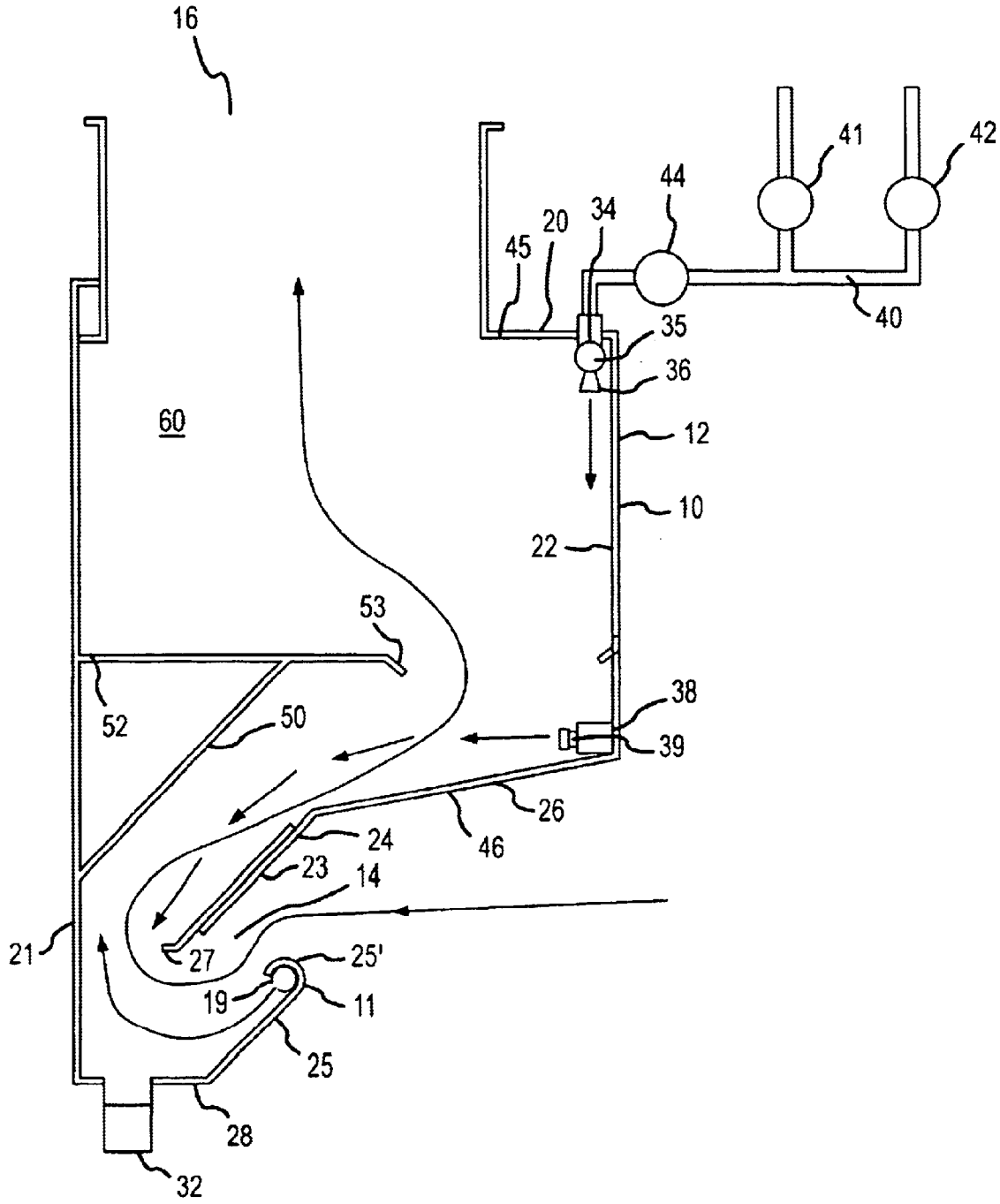
FIG. 1 is an enlarged cross-sectional view in accordance with the present invention.
Figure 2:
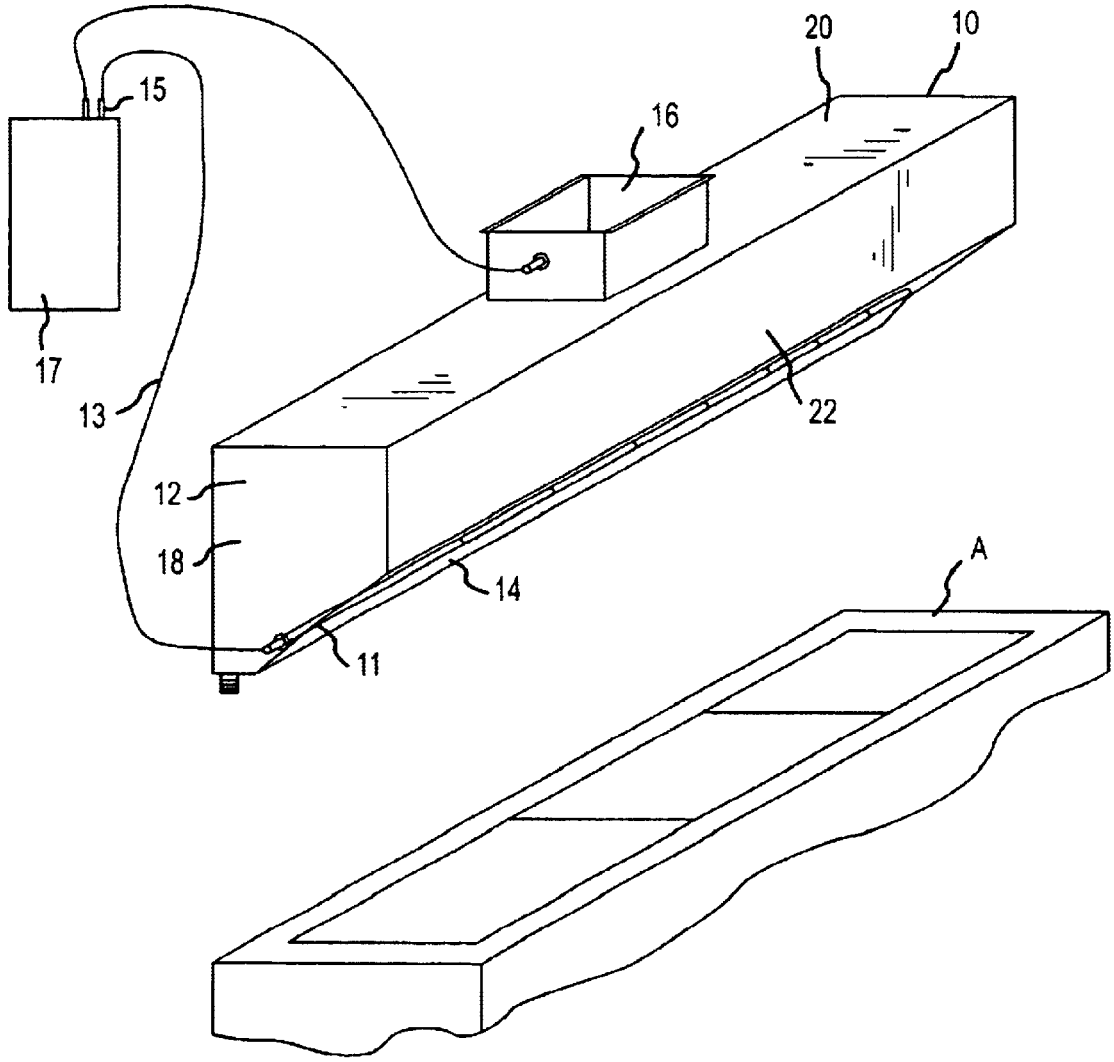
FIG. 2 is a perspective view of the ventilating system shown in FIG. 1.

Referring in more detail to the drawings, specifically FIGS. 1 and 2, a preferred form of ventilator apparatus 10 is installed in a conventional manner above a cooking appliance A and is made up broadly of a hood or housing 12 having a lower inlet passage area 14 and an upper exhaust duct 16. In a well-known manner, the exhaust duct or collar 16 is connected into the flue of a chimney or other exhaust system available in the building, which typically includes an exhaust fan downstream of the exhaust duct 16, to induce the upward and outward flow of vapors and contaminants generated by the cooking appliance through the air inlet passage 14.

In the preferred form, the hood 12 is of generally rectangular configuration and elongated to traverse the substantial width of the cooking appliance and with the air inlet passage centered in spaced relation above the appliance. As further shown in FIGS. 1 and 2, the exterior of the hood 12 includes opposite end walls 18, a top horizontal wall 20 and rear and front vertical walls 21 and 22 extending between the end walls 18. The air inlet passage 14 is formed between spaced, parallel, upper and lower inclined panel sections 24 and 25, respectively. Lower panel 25 terminates in a reverse curved lip 25' facing inwardly toward the air passage 14 and upwardly toward the panel or baffle member 24.

Inserted within the interior walls of the reverse curved lip 25 is a rigid stainless steel pipe 11 which extends the full length of hood 12 and protrudes through end wall 18 at which point it is connected to flexible stainless steel tubing 13 connected to an ozone output port 15 on an ozone producing apparatus 17. The rigid stainless steel pipe 11 under the reverse curved lip 25' is fitted with equally spaced round perforations 19 as seen in FIG. 1 to provide even distribution of ozone gas into the exhaust air along the full length of the air inlet passage 14.

Figure 2A:
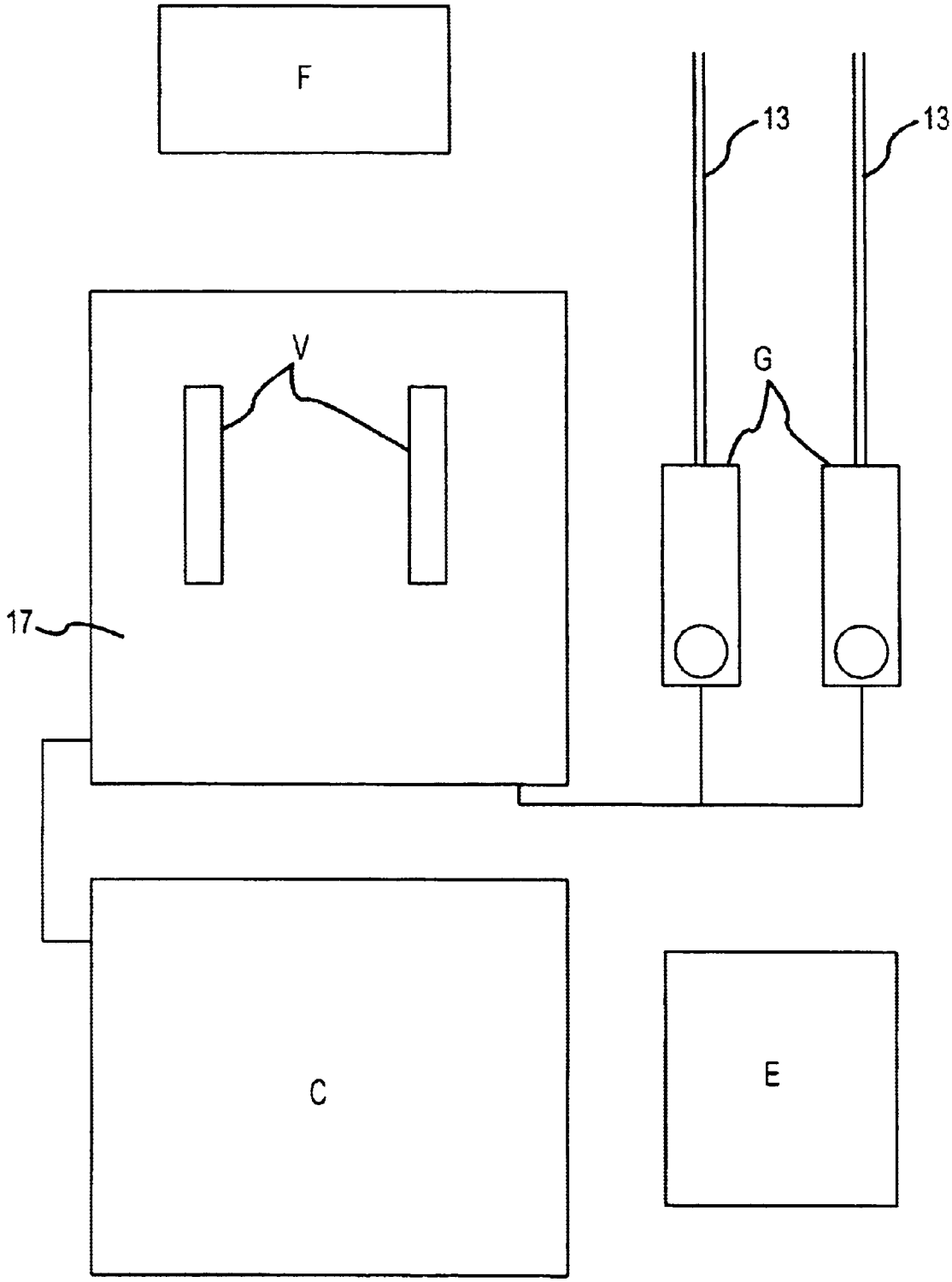

The flexible stainless steel pipe 13 connected to the end of rigid stainless steel pipe 11 shown in FIG. 2 extends to the ozone port 15 on the ozone producing apparatus 17 which may include an oxygen concentrator C, and cooling fan(s) F, adjustable flow gauges G, high voltage electrodes V, and electrical control panel F designed for proper sequence of operation for the oxygen concentrator C and the electrode electrodes V to accomplish removal of moisture within the ozone-producing apparatus 17 prior to its being turned on, and to accomplish removal of ozone gas from within the ozone-producing apparatus, the flexible stainless steel tubing 13, and the rigid stainless steel pipe 11 after the ozone-producing apparatus has been shut off. This is shown in FIG. 2A in accordance with well-known prior practice.

The air inlet passage 14, as best seen from FIG. 2, is formed between the spaced, parallel, upper and lower inclined panel sections 24 and 25, respectively. A lower inclined wall 26 is directed at a relatively low angle away from a front vertical wall 22, and an adjustable baffle plate member 23 forms a continuation of the panel 24 and is slidable toward or away from the rear wall 21 by loosening set screws (not shown) which releasably lock the baffle members 23 and 24; and the plate 23 terminates in a horizontal ledge 27 in closely spaced relation to the rear wall 21 as shown in FIG. 1. The lower panel 25 inclines forwardly and upwardly away from a horizontal support panel 28 at a lower edge of the rear wall 21, the panel 28 extends into a drain pipe 32 through which any excess water together with collected grease, fumes and contaminants are removed through the lower end of the hood 12.

A water feed pipe 40 includes a cold water solenoid valve 41 and hot water solenoid valve 42. Cold and hot water valves 41 and 42 are controlled by a valve controller (not shown) preferably, a Siemens programmed logic controller made by Siemens Aktiengesellschaft Joint Stock Co. of Munich, Germany. The hot and cold valves 41 and 42 are mounted on top of the hood 12 directly above the water feed pipe and are connected together forming the water feed pipe 40. Located within the pipe 40, downstream from the hot and cold water solenoid valves 41 and 42 is an injector 44, preferably a Dema injector, manufactured by The Dema Engineering Company, St. Louis, Mo., through which both hot and cold water flow, forming a venturi that draws liquid chemical into the incoming water.

An upper water inlet 34 is directed into manifold 35 at an upper interior corner of a top wall 20 and front wall 22; and the manifold 35 includes downwardly extending nozzles 36 which traverse the length of the front wall 22 directly beneath and supported by the top wall 20. Another lower water feed pipe 38 is positioned at an interior lower corner between the front wall 22 and lower wall 26 and is provided with a series of horizontally directed nozzles 39.

An important feature of the present invention resides in a scrubbing chamber which is formed directly above and in communication with the air inlet passage 14. An air deflector panel 50 extends upwardly and forwardly away from the rear wall 21 in spaced, substantially parallel relation to the panel 24, and the panel 50 functions also as a bracket support for a horizontal deflector panel or plate 52 which extends forwardly away from the rear wall 21 and terminates in a downwardly directed lip 53. The horizontal panel 52 forms a horizontal extension of the inclined deflector plate 50 and, together with the plate 50, defines a forwardly convergent scrubbing chamber or area for intermixing of the exhaust airstream from the cooking appliance with the water droplets from the water manifold 44. An upper open plenum area 60 is formed by the outer walls of the hood 12 above the scrubber chamber and specifically above the horizontal deflector 52.

In practice, when the exhaust fan is turned on, the logic controller directs the release of cold water and detergent through the pipe 40 and the manifolds 35 and 38 for downward movement along the wall 26 into the scrubbing chamber area as defined. The exhaust airstream is drawn initially in a downward direction through the inlet passage 14, ozone gas is injected into the exhaust airstream through the rigid steel pipe 11, then ozonated exhaust air is caused to undergo a reversal in flow around the lower edge of the panel 24 and advance upwardly through the scrubbing chamber. As the air flow turns upwardly and advances past the downward flow of water and draws the water upwardly to a level adjacent to the lip 53 where the air velocity decreases and allows the water to fall in a somewhat circular path toward the walls 22 and 26. As the water continues to move downwardly along the lower wall 26 in countercurrent relation to the flow of air it will once again be picked up by the flow of air thereby creating a vortex action with the water in continuous suspension in the airstream. The volume of water in suspension will vary in accordance with the air flow volume and the setting of the air inlet baffle plate 23. When the scrubbing chamber has absorbed the maximum capacity of water into the air, any excess water will escape from the chamber and advance along the panel 21 into the lower trough or the drain section 28, and the water will tend to collect any grease vapors or other contaminants and carry the contaminants away with it as it is drained off through the bottom, particularly any of the heavier or solidified particles of grease.

Typically, the ventilator system will run continuously in a commercial establishment and, at the end of the day, when the exhaust fan is shut off, the water held in suspension will drain into the drain system. The upper and lower manifolds 35 and 38 contain detergent and hot water, generated by the logic controller through the hot water solenoid valve 42, to flush the scrubbing chamber and total interior of the hood. After the cleaning cycle is completed or the exhaust fan turned on, fresh cold water will then refill the scrubbing chamber to form a continuous water filter as described.

It will be evident from the foregoing that any necessary adjustments to the baffle plate 23 and the valves 41, 42 can be made at the time of installation according to the mass flow rate of air from the working equipment. The cold water released at the opposite ends 45 and 46, and the length of the housing will migrate across the entire length of the panel 26 to effectively form a continuous sheet or stream of water flowing across the length of the panel 26 and downwardly toward the scrubbing chamber so that a water filter is formed effectively along the length of the housing. Removal access panels (not shown) are provided on the front wall 22 in order to gain entry into the interior plenum area 60 for maintenance or repair and periodic cleaning of the interior of the hood 12.

The invention may also run as a "dry" system without addition of water through manifolds 35 and 38. The exhaust airstream is drawn in a downward direction through the inlet passage 14, ozone gas is injected into the exhaust airstream through the pipe 11, then ozonated exhaust air is caused to undergo a reversal in flow around the lower edge of the panel 24 and advance upwardly through the scrubbing chamber. The reversal in flow causes further intermixing of the ozone with the exhaust airstream resulting in oxidation of contaminants and formation of oxygen gas. The ozonated exhaust air, oxygen and oxidized contaminants continue to move upwardly towards the lip 53, causing a slight reversal in the air flow, resulting again in further intermixing. The exhaust airstream then continues upwardly through the open plenum area 60 and exits through the duct 16.

Figure 3:
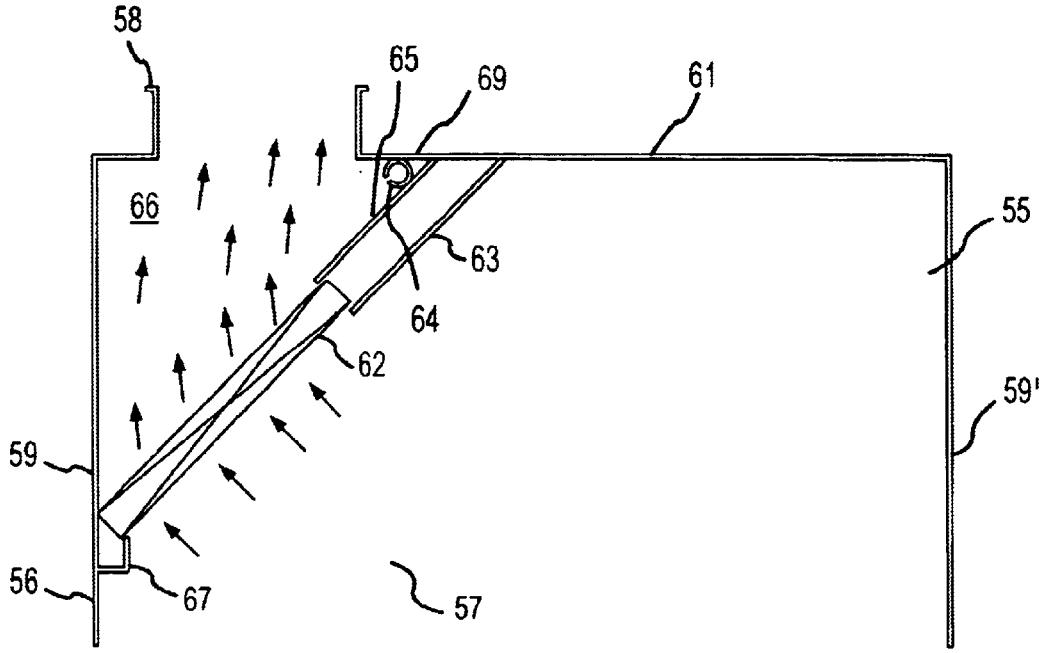
FIG. 3 is an enlarged cross-sectional view of an alternative embodiment of the present invention.

In an alternate embodiment of the present invention as seen in FIG. 3, a ventilator apparatus 55 is made up broadly of a hood 56 having a lower inlet passage area 57 and an upper exhaust duct 58. The exhaust duct 58 includes an exhaust fan (not shown) installed downstream in an exhaust system designed to direct the flow of exhaust air through the hood into the exhaust system and outside into the atmosphere.

In this form, the hood 56 is of generally rectangular configuration and elongated to traverse the substantial width of the cooking appliance. As shown in FIG. 3, the hood 56 includes rear and front vertical walls 59, 59', respectively, a top horizontal wall 61 and side vertical walls (not shown) extending between the vertical walls 59, 59'. Placed within the hood 56 is a metal baffle-type filter 62 which is placed diagonally along an upper corner between the rear wall 59 and the top horizontal wall 61. The filter 62 is secured in place by upper filter support walls 63 and 65 and lower support bracket 67.

Inserted within a corner formed between the top wall 61 and the upper filter support 65 is a rigid stainless steel pipe 69 which extends the full length of the hood 56 and protrudes through the side wall, not shown, at which point it is connected to flexible stainless steel tubing and downline to an ozone generator as described earlier. The rigid stainless steel pipe 69 is fitted with equally spaced round perforations 64 to provide even distribution of ozone gas into the exhaust air along the full length of an air outlet plenum 66.

In practice, when the exhaust fan is turned on, the exhaust airstream is drawn upwardly through the inlet area 57 and passes through the baffle filter 62 at a high velocity. As the exhaust air moves through the baffle filter 62, grease, vapors or other contaminants are removed from the exhaust air and any remaining grease vapors and exhaust air move through to the air outlet plenum 66. Ozone gas is injected through the exhaust airstream through the pipe 69, out through the perforations 64, causing intermixing of ozone with the exhaust airstream, resulting in oxidation of contaminants forming byproducts, such as, oxygen and water.

Figure 4:
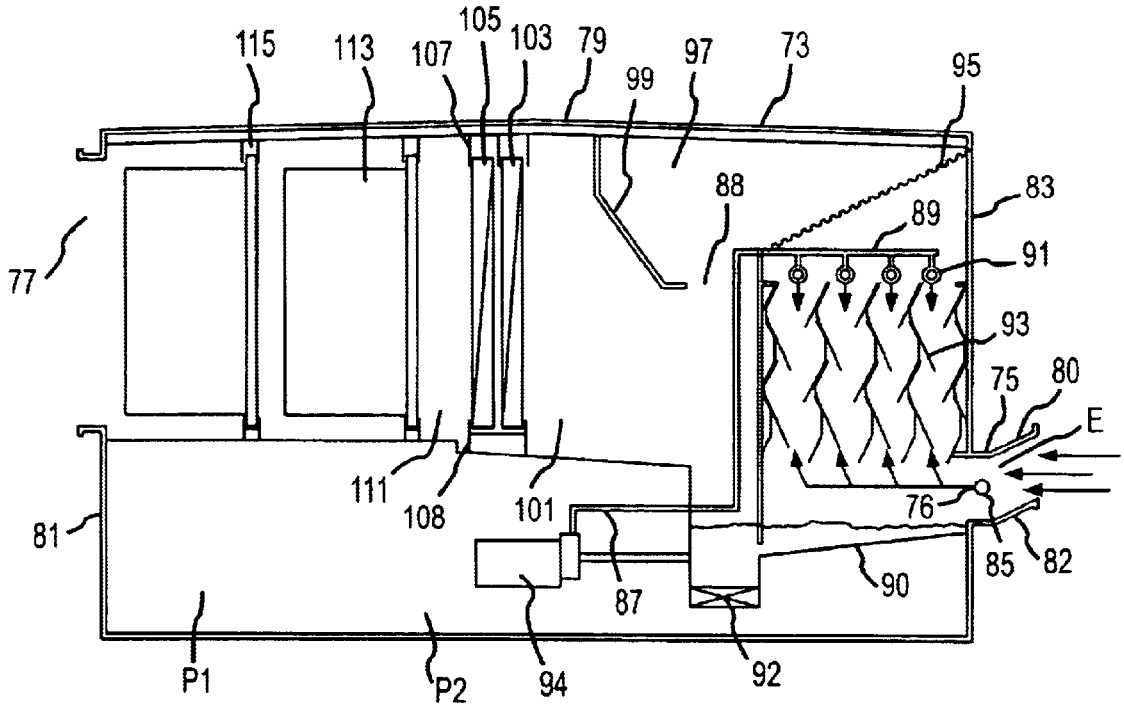
FIG. 4 is a cross-sectional side view of an alternate embodiment of the present invention.
Figure 5:
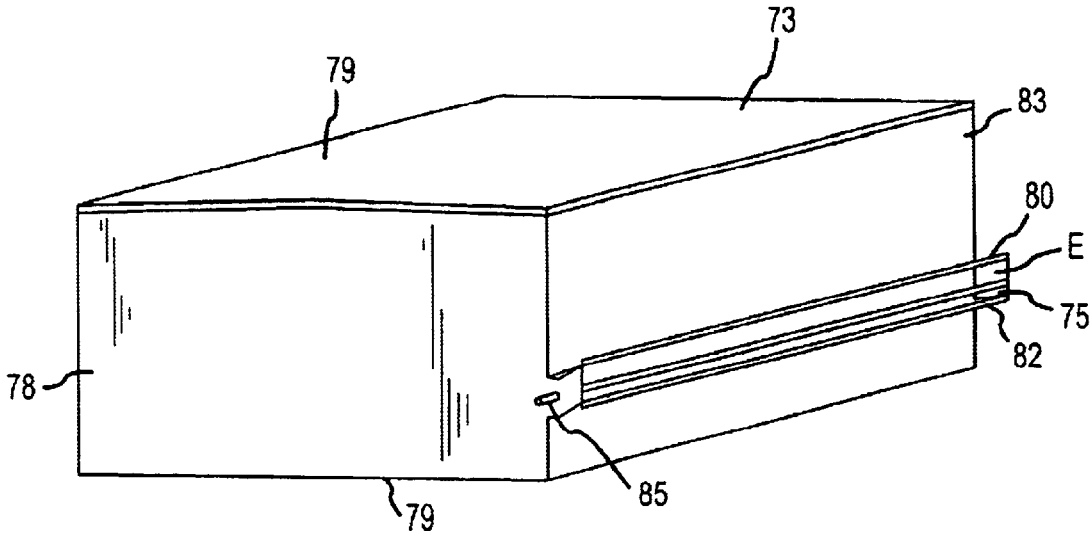
FIG. 5 is a perspective view of the alternate embodiment shown in FIG. 4.

In another alternate form of the present invention, as shown in FIG. 4, a ventilator apparatus is made up of a housing 73 having a side inlet passage area 75 and an opposite side exhaust area 77. In this form, the housing 73 is of generally rectangular configuration. As shown in FIGS. 4 and 5, the exterior of the housing 73 includes opposite end walls 78, top and bottom horizontal walls 79 and rear and front vertical walls 81 and 83, respectively, extending between the end walls 78. The air inlet passage 75 is formed between spaced, parallel, upper and lower inclined panel sections 80 and 82, respectively.

Located at the entryway E of the inlet passage 75 is a rigid stainless steel pipe 85 which extends the full length of the front vertical wall 83 and protrudes through the end wall 78 at which point it is connected to flexible stainless steel tubing which is then connected to an ozone outlet port 15 on the ozone producing apparatus 17 as described earlier and as shown in FIG. 2. The rigid stainless steel pipe 85 is fitted with equally spaced round perforations 76 to provide even distribution of ozone gas into the exhaust air along the full length of the air inlet passage 75.

A water inlet 87 is directed into manifold 89 at an upper interior portion of housing 73. The manifold 89 includes downwardly extending nozzles 91 which are at spaced intervals extending along the full length of the front vertical wall 83. Water is discharged into a lower front end of the housing 73 where it advances along panel 90 into lower trough 92 where it is piped to a recirculating water pump 94 and pumped back through the water inlet 87 up to the manifold 89.

An important feature of the present invention resides in a scrubbing chamber which is formed directly above and in communication with the air inlet passage 75. Spaced diverter panels 93 are located directly beneath the nozzles 91 and together with perforated plate 95 defines a forwardly convergent scrubbing chamber or area for intermixing of the exhaust airstream with the ozone and water droplets from the manifold 89.

An upper open plenum area 97 is formed by an upper surface of the perforated plate 95 above the scrubber chamber and air deflector panel 99. The perforated plate 95 is preferably formed of a metal sheet containing perforations to cause further intermixing of the exhaust airstream with the ozone. The air deflector panel 99 extends downwardly and forwardly towards the front wall 83. A secondary plenum area 101 is formed by the air deflector panel 99 and an outer surface of primary filter 103. There is a secondary filter 105 which is located parallel and contiguous to the primary filter 103. The filters 103 and 105 form a filtration barrier in conjunction with upper and lower filter supports 107 and 108, respectively.

A tertiary rear plenum area 111 includes at least one row, preferably two, of high efficiency filters 113 and 115 which are preferably high efficiency glass fiber filters. The filters are located in a rear, upper portion of housing 73 to provide final filtration of the exhaust airstream prior to exiting through the side exhaust area 77.

In practice, when the exhaust fan is turned on, the recirculating pump 94 is turned on which allows for recirculation of water along the water inlet 87 into the scrubbing chamber area as defined. The exhaust airstream is drawn initially through the inlet passage 75, through use of an exhaust fan, then is intermixed with ozone gas through use of the ozone generator as previously described. The ozonated exhaust air is drawn upwardly through the diverter panels 93. As the exhaust air flows upwardly into the diverter panels 93, the exhaust airstream is forced in variable directions causing further intermixing of the exhaust airstream with ozone gas and the downwardly flowing water. As the water continues to move downwardly along the diverter panels 93 in countercurrent relation to the flow of ozonated air, it will once again be picked up by the flow of air thereby creating a vortex action with the water in continuous suspension in the airstream. When the scrubbing chamber has absorbed the maximum capacity of water into the air, any excess water will escape from the chamber, advance along the panel 90 and will collect in the trough 92 for recirculation. The exhaust airstream continues to travel upwardly through the diffuse plate 95 causing further mixing of the exhaust air, ozone gas and water. The exhaust air then travels upwardly and along the deflector panel 99 which creates a vortex action and forces the exhaust airstream through a deflector passage 88 and into the secondary plenum area 101. The exhaust air is then drawn through the mesh filters 103 and 107 for further removal of moisture from the exhaust airstream. The exhaust airstream exits the filters 103 and 107 and enters the rear tertiary plenum area 111 where the exhaust stream is drawn through at least one row of the filters 113 to remove particles and finally through the side exhaust area 77. Preferably, housing 73 include at least two rows of high efficiency glass fiber filters for removal of submicron particles. Preferably the filters are rated at 90% to 95% efficiency for one micron-sized particles. Higher or lower efficiency filters can be utilized as required for individual applications. If desired, charcoal filters can be substituted or added to the tertiary plenum area 111 so as to control odor. Removal access panels $P_1$ and $P_2$ are provided on a front of the wall 78 in order to gain entry into the interior for maintenance or repair and cleaning, if necessary, of the interior.

Figure 6:
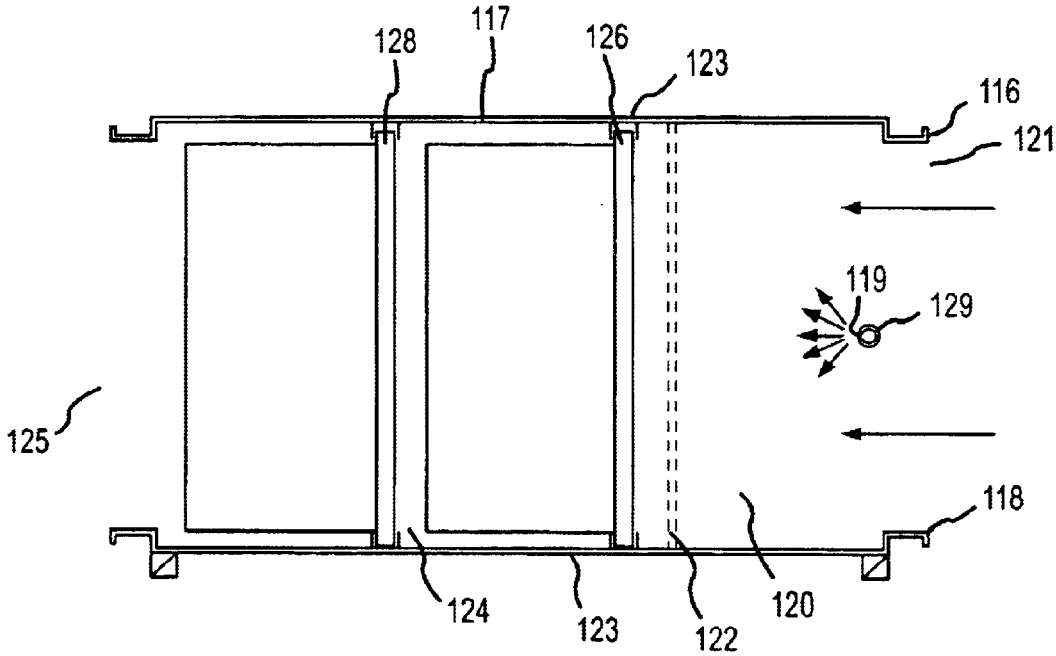
FIG. 6 is a cross-sectional side view of another alternative embodiment of the present invention.
Figure 7:
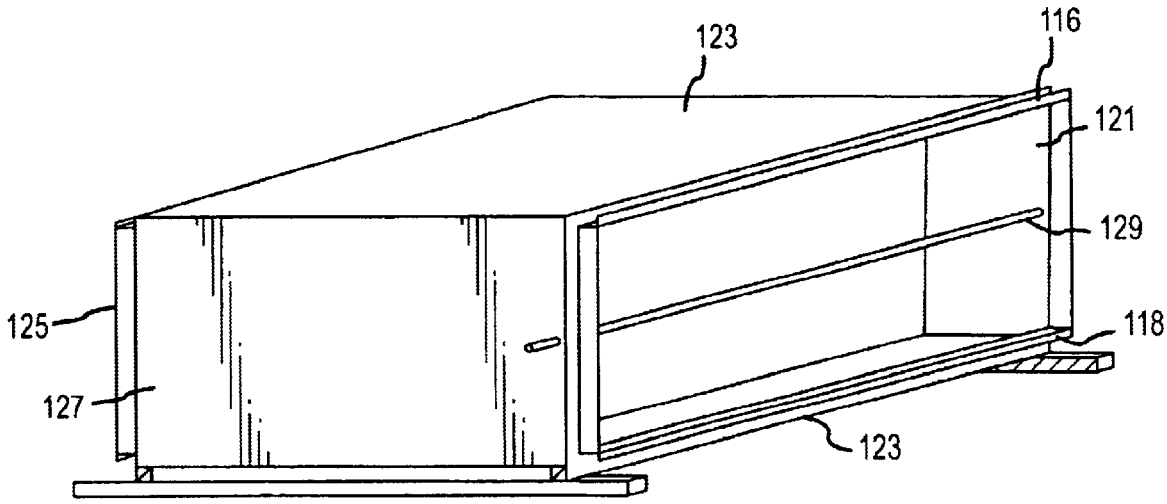
FIG. 7 is a perspective view of the alternative embodiment shown in FIG. 6.

Another embodiment of the present invention is a dry scrubber which includes a housing 117 which is of generally rectangular configuration and elongated to traverse the substantial width of a cooking appliance. As shown in FIGS. 6 and 7, the exterior of the housing 117 includes opposite top and bottom walls 123, air inlet passage 121 and a rear vertical exit passage 125 extending between side walls 127. Inserted through the side walls 127 at the opening of the air inlet passage 121 is a rigid stainless steel pipe 129 which extends the full width of the housing 117 and protrudes through the walls 127. One end of the pipe 129 is connected, as described earlier, to an ozone-producing apparatus, shown in FIG. 2. The rigid stainless pipe 129 is fitted with equally spaced, round perforations 119 to provide even distribution of ozone gas into the exhaust air along the full length of the air inlet passage 121.

The air inlet passage 121, as seen in FIGS. 6 and 7, is formed between spaced parallel upper and lower panel sections 116 and 118, respectively. Housing 117 contains a forward plenum area 120 including a diffuse plate 122, which is preferably a perforated metal plate traversing a portion of the front plenum area 120. A rear plenum area 124 includes at least one, preferably two, rows of filters 126 and 128. The filters 126 and 128 traverse the width of the rear plenum area 124 and are preferably high efficiency glass fiber filters rated at a 90% to 95% efficiency for one micron-sized particles. Higher or lower efficiency filters can be utilized and, if desired, charcoal filters may be substituted for the filter 128 or added as an additional filter in the rear plenum area 124.

In practice, when the exhaust fan is turned on, the exhaust airstream is drawn in a horizontal direction through the inlet passage 121. The exhaust air is intermixed with ozone gas from the pipe 129 and is drawn horizontally through the diffuse plate 122 causing further intermixing of ozone gas with the exhaust airstream. The exhaust airstream passes horizontally through the filters 126 and 128 for removal of submicron particles, the exhaust air flowing through the exit passage 125.

In all applications, the ozone generation is continuous and is injected continuously into the housing but the concentration of ozone will vary according to the mass flow rate of the exhaust airstream through the entrance passage. In general, each application utilizing water injection means may also be used in a "dry" application. There are some instances when it is impractical or inconvenient to use water injection as well as to provide for water and waste drainage. In these situations, utilization of ozone in combination with the exhaust airstream as well as at least one baffle filter, allows for removal of contaminants including odors while minimizing the amount of water that must be removed from the housing.

It is therefore to be understood that while preferred and alternate embodiments of the present invention are set forth and described herein, various modifications and changes may be made without departing from the spirit and scope of the present invention as defined by the appended claims and reasonable equivalents thereof.

I claim:

1. In apparatus for extracting grease and other contaminants from an exhaust airstream in which a housing is provided with means for inducing the flow of the exhaust airstream therethrough, diverter means in said housing to cause reversal in the direction of flow of the exhaust airstream, and water-injecting means for injecting water into the housing in countercurrent relation to the flow of the exhaust airstream, the improvement comprising:

a source of ozone; and means for injecting said ozone continuously into the exhaust airstream prior to intermixture of the exhaust airstream with the water whereby to create a vortex of ozonated water for efficient removal of the grease, odors and other contaminants from the airstream.

2. In apparatus according to claim 1 wherein said diverter means is adjustable to vary the size of said entrance passage in said housing through which said exhaust airstream intermixed with said ozone enters.

3. In apparatus according to claim 1 wherein said source of ozone includes oxygen concentration means whereby to aid in the generation of ozone.

4. In apparatus according to claim 1 wherein said means for injecting ozone includes a rigid stainless steel pipe with equally spaced perforations to provide even distribution of ozone gas into the exhaust airstream through said diverter means.

5. In apparatus for extracting grease, odors and contaminants from an exhaust airstream in which a housing is provided having a baffle chamber with a pair of spaced diverter panels and a baffle member therebetween to cause reversal in the direction of flow of said exhaust airstream, an entrance passage for said exhaust airstream, an exit duct, means for inducing the upward flow of said exhaust airstream through said baffle chamber, and means for collecting and draining said grease, odors and contaminants along with any moisture present in said exhaust airstream from a bottom of said chamber, the improvement comprising:

means for generating ozone; and discharge means for injecting said ozone from said ozone generating means continuously into the exhaust airstream prior to reversal of the direction of flow of said exhaust airstream whereby to create a vortex of ozonated exhaust air for efficient removal of the grease, odors and other contaminants from the airstream.

6. In apparatus according to claim 5 wherein said discharge means includes a rigid stainless steel pipe with equally spaced perforations to provide even distribution of said ozone gas into the exhaust airstream through said baffle chamber.

7. In apparatus according to claim 6 wherein said housing includes means for injecting water in sheet form downwardly along a wall portion of said baffle chamber in countercurrent relation to the flow of the exhaust stream, whereby to cooperate with said baffle member to create a vortex of water droplets and air in the path of flow of said exhaust airstream through said baffle chamber.

8. In apparatus according to one of claims 6 and 7 wherein said discharge means operates continuously and concurrently with said means for injecting water and said means for inducing the outward flow of said exhaust airstream through said baffle chamber.

9. In a ventilating system for extracting grease, odors and contaminants from an exhaust airstream wherein a housing includes a lower entrance passage for said exhaust airstream, a front wall, a rear wall, opposite end walls to a common enlarged plenum area, and an exit duct including means for inducing the flow of said exhaust airstream upwardly through said housing, said housing including baffle means having spaced diverter panels and a baffle member therebetween, a lower substantially horizontal wall extending rearwardly from said front wall and merging into said baffle member, said baffle member inclining downwardly and rearwardly away from said lower wall, and a horizontal ledge at a lower terminal edge of said baffle member, the improvement comprising:

means for generating ozone; and ozone discharge means for injecting said ozone into said said lower entrance passage whereby to uniformly distribute said ozone into said exhaust airstream prior to contact with said baffle means.

10. In a ventilating system according to claim 9, said baffle member including an adjustable plate member movable in a direction to modulate the cross-sectional area between said entrance passage and said reduced cross-sectional area, said adjustable baffle plate member including a lower edge in spaced facing relation to said rear wall.

11. In a ventilating system according to claim 9, said spaced diverter panels disposed in substantially parallel relation to one another and inclining upwardly in a forward direction to define upper and lower inclined deflector panels, said lower deflector panel having a reverse curved edge at an upper end thereof.

12. In a ventilating system according to claim 9 wherein said housing includes water-injecting means with a manifold extending along said front wall and terminating in opposite discharge ends interiorly of said front wall, and valve control means for regulating the flow rate of water injected through said manifold.

13. In a ventilating system according to claim 9, wherein said housing includes a detergent/water injection system for cleaning the interior of said housing.

14. A ventilating system for extracting grease, odors and solid particles from an exhaust airstream, said ventilating system comprising:

a housing including an entrance passage, baffle means in said housing, and a dry chamber;

ozone generating means;

means for inducing the flow of said exhaust airstream through said entrance passage, said entrance passage having means for injecting ozone into said exhaust airstream at said entrance passage whereby to provide even distribution of said ozone gas into the exhaust airstream;

said baffle means having spaced diverter panels; and means for injecting water into said housing from a location above said baffle means in countercurrent relation to the flow of said ozonated exhaust airstream through said baffle means whereby to cooperate with said baffle means in mixing water droplets and air in the path of flow of said ozonated exhaust airstream through said housing.

15. A ventilating system according to claim 14 wherein said housing includes an upper vertical wall inclining downwardly and diagonally terminating in a horizontal ledge to cause reversal in the direction of flow of said exhaust stream.

16. A ventilating system according to claim 14 wherein said means for injecting ozone into said housing includes a rigid stainless steel pipe with equally spaced perforations to provide even distribution of ozone gas into the exhaust airstream through said entrance passage.

17. A ventilating system according to claim 14 wherein said means for injecting water into said housing operates continuously and concurrently with said means for inducing flow of said exhaust airstream through said housing and said means for injecting ozone through said housing.

18. A method for extraction of grease odors and solid particles from an exhaust airstream wherein a housing includes an entrance passage, an exit duct, comprising the steps of:

directing the exhaust airstream into said housing;

generating ozone at a location outside of said housing;

injecting said ozone continuously into the exhaust airstream at said entrance passage and adjusting the concentration of ozone according to the mass flow rate of the exhaust airstream;

intermixing the exhaust airstream with the ozone to form an exhaust airstream ozone mixture;

diverting the direction of flow of the exhaust airstream ozone mixture within said housing whereby to cause the flow of the exhaust airstream ozone mixture to be reversed; and oxidizing organic matter in the airstream including grease vapor and particles for removal from the airstream.

19. The method according to claim 18 wherein the steps further comprise injecting water into said housing in countercurrent relation to the flow of the exhaust airstream.

20. The method according to claim 18 wherein the steps further comprise generating ozone with an oxygen concentration member and high voltage electrodes.

21. The method according to claim 18 wherein the steps further comprise injecting said ozone and inducing the flow of said exhaust airstream ozone mixture continuously and concurrently with said water through said housing.

22. The method according to claim 18 wherein the steps further comprise removing any moisture within said housing through a drain member.

23. The method according to claim 18 wherein the steps further comprise removing particulates and any moisture from said housing with a baffle filter.

24. The method according to claim 18 wherein the steps further comprise ozonating contaminants within said housing resulting in oxidation of target compounds.

* * * * *